United States Patent [19]

Moore

[11] Patent Number: 4,667,935

[45] Date of Patent: May 26, 1987

[54] METAL FENCING, GRATINGS AND THE LIKE EMPLOYING NOVEL INTERCONNECTING MEANS AND METHOD OF ASSEMBLY

[76] Inventor: Robert S. Moore, 5070 Calle La Vela, Tucson, Ariz. 85718

[21] Appl. No.: 875,178

[22] Filed: Jun. 17, 1986

[51] Int. Cl.[4] ..... B21F 27/00; E04H 17/16

[52] U.S. Cl. ..... 256/22; 256/69; 403/347

[58] Field of Search ..... 256/22, 21, 59, 65, 256/69; 403/347

[56] References Cited

U.S. PATENT DOCUMENTS

| | | | |
|---|---|---|---|
| 220,392 | 10/1879 | Lauth | 256/22 |
| 262,448 | 8/1882 | Maunder . | |
| 626,733 | 6/1899 | Stewart et al. . | |
| 791,327 | 5/1905 | Dale . | |
| 1,963,981 | 6/1934 | Garrett | 25/131 |
| 3,033,532 | 5/1962 | McFall | 256/21 |
| 3,067,985 | 12/1962 | Cusack | 256/22 |
| 3,218,036 | 11/1965 | Kozub | 256/22 |
| 3,414,236 | 12/1968 | Siegal | 256/59 X |
| 3,724,865 | 4/1973 | Cristie | 280/7.11 |
| 3,724,884 | 4/1973 | Roider | 287/52.08 |
| 3,822,053 | 7/1974 | Daily | 256/21 X |
| 3,849,008 | 11/1974 | Boucher et al. | 403/104 |
| 4,435,103 | 3/1984 | Becker et al. | 403/292 |
| 4,474,299 | 10/1984 | Andrews | 211/193 |

FOREIGN PATENT DOCUMENTS

| | | |
|---|---|---|
| 1056786 | 10/1953 | France . |

*Primary Examiner*—Andrew V. Kundrat

*Attorney, Agent, or Firm*—Warren F. B. Lindsley

[57] ABSTRACT

A method for joining tubular members at right angles for use in the construction of a rail and pole metal fence, grating and the like, in which the poles are inserted in prepunched multi-sided clearance holes in the rails and are secured therein by means of set screws, serrated pins or nails.

3 Claims, 9 Drawing Figures

METAL FENCING, GRATINGS AND THE LIKE EMPLOYING NOVEL INTERCONNECTING MEANS AND METHOD OF ASSEMBLY

BACKGROUND OF THE INVENTION

Fences utilizing metal pickets or poles have been popular for many years, and are strong, durable and attractive, requiring little or no maintenance. Wrought iron fences have become especially popular in recent times as protective fencing around swimming pools, gardens and serve as security barriers around patios and entryways. Similar decorative barriers have been employed as protective grates over the windows of homes and other structures.

Wrought iron fences are typically welded together, and are usually constructed and installed by professional artisans. For this reason, they are relatively expensive.

If the merits of iron fencing are to be enjoyed by a broader segment of the population, a simpler construction method must first be found utilizing procedures that are within the skills of the ordinary handyman or "do-it-yourself" nonprofessional person.

The present invention is directed toward new and improved apparatus which may be employed in the construction of metal grating and fencing, and a novel method for interconnecting tubular metallic members into similar structures and assemblies.

DESCRIPTION OF THE PRIOR ART

Interconnection of tubular members are described in the following prior art.

French Pat. No. 1,056,736 discloses a round bar or lever passing through a hole extending laterally through the enlarged end of a shaft and secured therein by a set screw.

U.S. Pat. No. 3,724,884 discloses a set screw with serrations for penetrating a rod, the screw securing a round shaft concentrically mounted inside a hub.

U.S. Pat. Nos. 262,488; 791,327; 626,733; 1,963,981; 4,435,103; 3,724,865; 3,849,008 and 4,474,299 disclose interconnecting tubular or solid members through the use of set screws or other fasteners.

In U.S. Pat. Nos. 3,724,865 and 3,849,008, set screws are employed to secure the joining of two tubular or solid members that are coaxially arranged with the smaller of the two being inserted into the end of the larger. The remaining above identified patents employ additional fittings at the joint with a set screw or other fastener employed to secure the coupling of the fitting to the tubular member or members. U.S. Pat. No. 791,327 employs the set screw to secure the mounting of a shaft or blade to a tubular member, the blade being passed through a slit in the tubular member.

SUMMARY OF THE INVENTION

In accordance with the invention claimed, new and improved parts and method of assembly are provided for the construction of metal fence and grating panels, employing the joining together at right angles two square or rectangular tubular members of different cross-sectional dimensions. The joint is made by passing the smaller member through a square or rectangular clearance hole in the larger member which is secured by means of a set screw, pin, serrated nail or other suitable connection.

It is, therefore, an object of this invention to provide a new construction or form of pole and rail metal grate and fence assembly.

Another object of this invention is to provide novel grate and fence construction in a form that may be readily assembled from a set of component parts by a handyman of ordinary skill and experience without the use of welding equipment or other special tools.

A still further object of this invention is to provide a method for joining at right angles two tubular metal members of different cross-sectional dimensions.

A still further object of this invention is to provide such a joining method that requires no coupler or other hardware at the joint other than a set screw, pin or serrated nail.

A still further object of this invention is to provide such a fence construction that may be assembled from a kit of a minimum number of parts.

A still further object of this invention is to provide in such a fence construction a high degree of modularity such that an appropriate quantity of standard components may be employed to build a grate, fence or enclosure of any desired dimensions.

A still further object of this invention is to provide a novel collection of tubular parts that may be assembled in a novel manner to form fence parts, protective and decorative grates and screens for use over windows, around patios, entryways and the like.

Yet another object of this invention is to provide a fence or grate construction that rivals or equals wrought iron in beauty and utility and may be produced at a considerably lower cost.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described with reference to the accompanying drawing, in which.

DESCRIPTION OF THE PREFERRED EMBODIMENT

Figures 1, 2, 3, 4, 5, 6, 7, 8, 9:
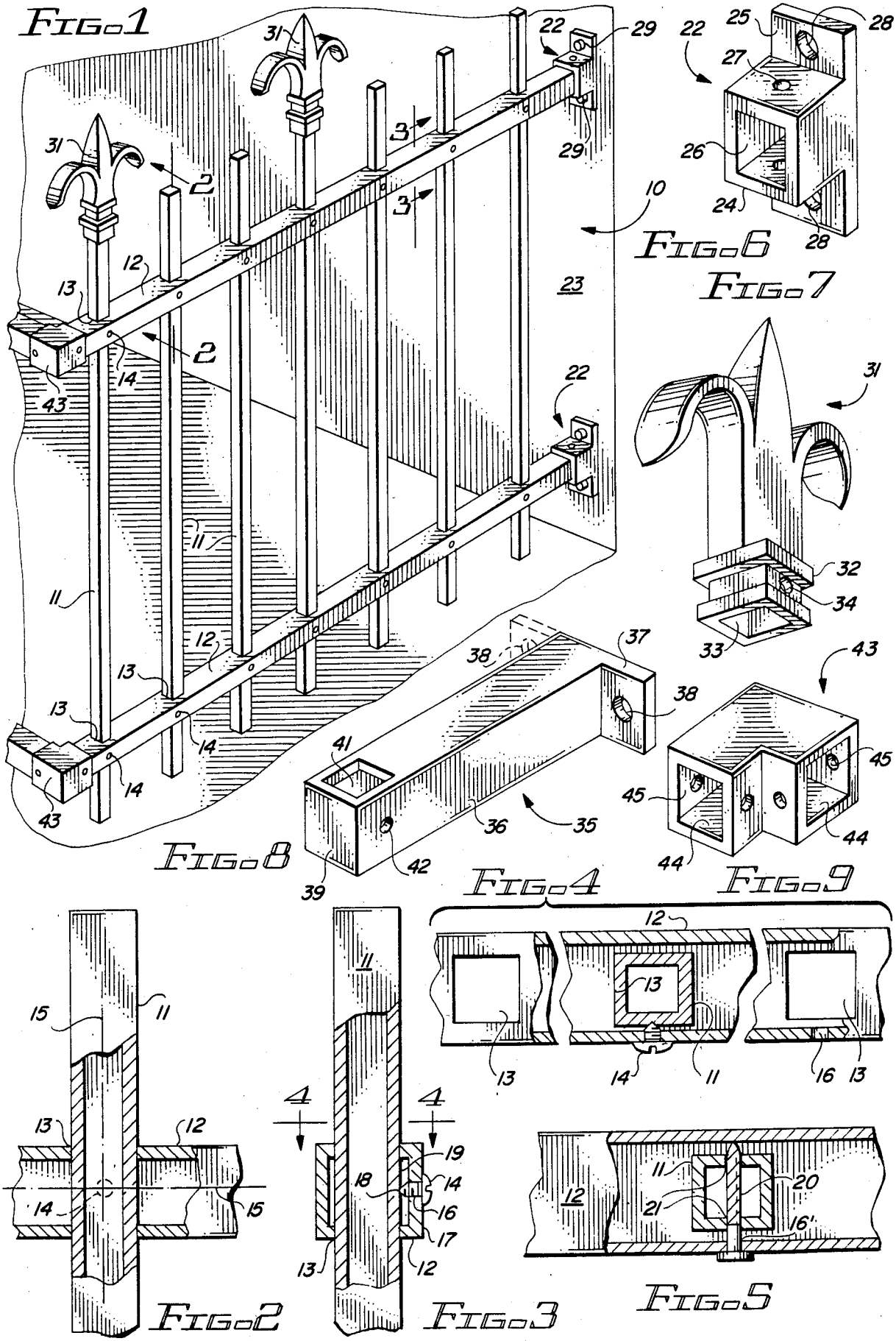
FIG. 1 is a perspective view of a portion of a fence comprising tubular metal poles and rails assembled and joined together in accordance with the teaching of the invention claimed herein.
FIG. 2 is a cross-sectional view of FIG. 1 taken along the line 2—2.
FIG. 3 is a cross-sectional view of FIG. 1 taken along line 3—3.
FIG. 4 is a cross-sectional view of FIG. 1 taken along the line 4—4.
FIG. 5 is a cut-away view similar to FIG. 4 illustrating a serrated nail as the securing means.
FIG. 6 is a perspective view of a rail anchor useful in mounting the end of a rail of the fence panel of FIG. 1 to the wall of a building or other surface.
FIG. 7 is an enlarged perspective view of a decorative ornament intended to be mounted at the top of a pole or stake of the fence as shown in FIG. 1.
FIG. 8 is a perspective view of a stand-off mounting post for use in securing the rails of a protective grating in front of a window.
FIG. 9 is a perspective view of a fitting intended as a coupling between rails that have adjoining right angles.

Referring more particularly to the drawing by characters of reference, FIGS. 1–9 disclose a decorative metal panel 10 for grate or fence use and associated parts and accessories and illustrative of the method of assembly embodying the invention.

Panel 10 comprises a grid of vertical multi-sided stakes, pickets or poles 11 supported by upper and lower multi-sided horizontal rails 12. The pickets and rails are preferably hollow metal tubular members formed of iron or aluminum with rectangular and preferably square cross sections with the rails typically having larger cross-sectional dimensions than the pickets or poles. As shown in FIG. 1, poles 11 pass through rectangular and preferably square clearance holes 13 in the rails and are secured therein by means of set screws 14 or other suitable connectors at each intersection. It should be noted that it is important that these clearance holes be at least three sided, thereby preventing the poles from rotating.

Clearance holes 13 are centered in the horizontal top and bottom surfaces of rails 12 and are equally spaced along the lengths of the rails. Holes 13 are just large enough to receive poles 11 without interference, but snug enough to assure a rigid structure.

Set screws 14 are turned into holes which may be threaded in the vertical face of the rail at the intersection of each pole and the tips of screws 14 impinge upon the faces of the intersecting poles with sufficient force to secure the positions of the poles within the holes 13.

The cut-away view of FIG. 2 illustrates the centered position of set screw 14 at the intersection of pole 11 and rail 12. Ideally, screw 14 is positioned at the intersection of the pole and rail centerlines 15.

FIG. 3 shows in a side view set screw 14 passing through a threaded hole 16 in face 17 of rail 12 with tip 18 of screw 14 impinging upon face 19 of pole 11. The cut-away top view of FIG. 4 is a further illustration of the same arrangement with additional illustration of the passage of poles 11 through square holes 13 in the rails 12.

While holes 16 are preferably threaded to receive set screws 14, a self-threading or sheet metal screw in combination with a smooth unthreaded hole may serve as an alternate construction.

A further alternative as a securing means is the use of a serrated pin or nail instead of the set screw. As shown in FIG. 5, nail 20 is preferably passed through holes 21 in both walls of pole 11, the holes 21 being aligned with a clearance hole 16' in the face of rail 12.

The method as just described, might also be employed in joining rails 12 to an upright supporting post (not shown). In this case, a tubular metal post would be employed with a larger cross section than that of the rails with clearance holes for the rails passing horizontally through the posts. Where rail sections in such a construction meet at the posts, two set screws would be required, each securing the end of one of the abutting rails.

Anchor 22 shown in FIG. 6 may be employed as indicated in FIG. 1 to secure the end of rail 12 to wall 23 of a building or other structure. Anchor 22 comprises a square collar 24 that projects perpendicularly from an integral flat mounting plate 25. The square opening 26 of collar 24 fits snugly over the end of rail 12 and is secured thereon by means of a set screw that passes through a threaded hole 27 in collar 24 or by means of a screw or pin that passes through aligned holes in collar 24 and the end of rail 12. Mounting holes 28 are provided in plate 25 for mounting anchor 22 to wall 23 using screws 29.

Decorative effects employed in connection with wrought iron fences are also adaptable to the construction of the present invention. As illustrated in FIGS. 1 and 7, decorative ornaments 31 may be provided in a form that is readily mountable on the tops of poles 11. The collar 32 at the base of ornament 31 has a vertical opening 33 that fits snugly over the top of the pole and is secured thereon by means of a set screw, pin, nail or similar means passing through a hole 34 in collar 32.

The joining method and associated structure as described herein is also adaptable to the construction of tubular metal protective gratings for installation over windows. In the mounting of such a grating, it is desirable that the grating be spaced away from the frame of the window rather than flush with it. For this purpose, the stand-off mounting post 35 of FIG. 8 will be found useful.

These stand-off mounting posts 35 comprise a metal construction in which a hollow tubular stub 36 has been welded to (or cast integrally with) a flat plate 37, with plate 37 extending past both sides of stub 36 to allow room for a mounting hole 38 at each side. A cap 39 closes the outer end of stub 36 just beyond a square opening 41 that is cut into the side of stub 36 to receive the horizontal rail of a window grating. In an installation of this type, post 35 is rotated 90 degrees from the orientation shown in FIG. 8 with one such post 35 being placed at the end of each rail. The end of the rail enters opening 41 and is secured therein by a set screw turned into hole 42 or by other means as described earlier.

In an alternate use of post 35 in the same types of application, opening 41 is dimensioned to receive the end of a pole rather than a rail. In this case, the left-hand and right-hand poles of the grate are held at their top and bottom ends by posts 35.

In either case, opening 41 may be made to pass through one side wall of stub 36 or it may pass through both walls if it is desired that the rail or the pole be passed all the way through the stub.

Corner coupling 43 shown in FIG. 9 comprising two short tubular stubs joined at right angles in an "L"-shaped configuration which is useful in securing together the ends of rails where the rails meet at right angles as shown in FIG. 1. As indicated in FIG. 1, the ends of rails 12 enter openings 44 of couplers 43 and are secured therein by set screws turned into holes 45, or by screws that pass through aligned holes in coupling 43 and the ends of the rails.

The assembly of a fence of the type shown in FIG. 1 is a relatively simple task. The rails may be secured in place, one at a time, between posts or other supporting means. The poles are then inserted in the openings in the rails and are secured by means of set screws, pins, nails or the like. There are no heavy panels to be lifted in place as in the case of a wrought iron fence which is brought to the site in ten foot lengths. The installation can be readily handled with a few simple tools such as a screw driver, hammer, hack saw, and an electric drill.

The component parts of the fence, including the rails, poles, corner couplers, etc., can be made available at hardware stores or home improvement centers in standard lengths for purchase in the quantities and sizes needed for any given project. Such standardization coupled with high quantity production should result in a relatively low manufacturing cost.

It should be noted, that although the rails and poles disclosed herein, having a four-sided configuration, it is intended that the member may be three or more sided configurations and still fall within the scope of this invention.

A new fence construction together with a simple and effective means for joining its component parts is thus provided in accordance with the stated objects of the invention, and although but a single embodiment of the invention has been illustrated and described, it will be apparent to those skilled in the art that various changes and modifications may be made therein without departing from the spirit of the invention or from the scope of the appended claims.

What is claimed is:

1. A panel for fence, grating and other similar uses comprising:

at least a pair of spaced multi-sided tubular metallic rails parallelly arranged for fence and grating purposes, each of said rails being provided with a like number of similarly spaced aperture means extending substantially at right angles through the longitudinal axis of said rails, said aperture means each having a multi-sided closed configuration extending completely through said rails, a plurality of multi-sided tubular metallic pickets having an outside configuration similar to the configuration of said aperture means, each one extending snugly through aligned aperture means in each of said rails to form with said rails a panel, and fastening means terminating within the rail and penetrating a common side of each of said rails at the point of intersection of said pickets' centerline and the rail centerline and into said aperture means and engaging said pickets to firmly hold said pickets in said rails to form a rigid structure.

2. The panel set forth in claim 1 wherein:

said multi-sided tubular rails and said multi-sided aperture means and said multi-sided pickets, each comprising a four-sided configuration.

3. The panel set forth in claim 1 wherein:

said fastening means comprises a self-threading metal screw.

* * * * *